US007073359B2

(12) United States Patent
San Jose Santamarta

(10) Patent No.: US 7,073,359 B2
(45) Date of Patent: Jul. 11, 2006

(54) ROTARY LOCKING MECHANISM, WHICH IS PREFERABLY INTENDED FOR LOCK CYLINDERS

(75) Inventor: Ignacio Alberto San Jose Santamarta, San Sebastian (ES)

(73) Assignee: Tallers De Escoriaza, S.A., Irun (ES)

( * ) Notice: Subject to any disclaimer, the term of this patent is extended or adjusted under 35 U.S.C. 154(b) by 0 days.

(21) Appl. No.: 10/544,051

(22) PCT Filed: Feb. 9, 2004

(86) PCT No.: PCT/ES2004/000054

§ 371 (c)(1),
(2), (4) Date: Sep. 15, 2005

(87) PCT Pub. No.: WO2004/074605

PCT Pub. Date: Sep. 2, 2004

(65) Prior Publication Data

US 2006/0048552 A1 Mar. 9, 2006

(30) Foreign Application Priority Data

Feb. 19, 2003 (ES) ..... 200300406

(51) Int. Cl.
*E05B 47/06* (2006.01)

(52) U.S. Cl. ..... 70/278.7; 70/278.2; 70/278.3; 70/283.1; 292/144

(58) Field of Classification Search ..... 70/277, 70/278.1–278.3, 278.7, 283.1, 275, 282, 70/279.1; 292/144, 252, DIG. 60
See application file for complete search history.

(56) References Cited

U.S. PATENT DOCUMENTS

| | | | | |
|---|---|---|---|---|
| 4,789,859 | A * | 12/1988 | Clarkson et al. | 70/278.3 |
| 4,848,115 | A * | 7/1989 | Clarkson et al. | 70/278.2 |
| 5,542,274 | A * | 8/1996 | Thordmark et al. | 70/283 |
| 5,771,722 | A * | 6/1998 | DiVito et al. | 70/277 |
| 5,896,765 | A * | 4/1999 | Peyre et al. | 70/275 |
| 6,310,411 | B1 * | 10/2001 | Viallet | 70/277 |
| 6,363,762 | B1 * | 4/2002 | Kueng | 70/278.3 |
| 6,412,320 | B1 * | 7/2002 | Maniago | 70/277 |
| 6,609,402 | B1 * | 8/2003 | Blankenship et al. | 70/283.1 |
| 6,927,670 | B1 * | 8/2005 | Gokcebay et al. | 70/278.2 |

FOREIGN PATENT DOCUMENTS

| | | | |
|---|---|---|---|
| EP | 0 995 864 | | 4/2000 |
| EP | 995864 | A2 * | 4/2000 |
| ES | 2 159 152 | | 9/2001 |

* cited by examiner

*Primary Examiner*—Brian E. Glessner
*Assistant Examiner*—Christopher Boswell
(74) *Attorney, Agent, or Firm*—Nields & Lemack

(57) ABSTRACT

The invention relates to a rotary locking mechanism which is preferably intended for lock cylinders. The inventive mechanism includes an electric motor, a locking bolt, an inertial rotating mechanism which converts the rotation of the motor into a rectilinear movement along the axis of the locking bolt, an elastic energy accumulator which is arranged in opposition to the backward retraction travel of the locking bolt and a rectilinear guide mechanism for the working extension/retraction travel of the locking bolt.

6 Claims, 2 Drawing Sheets

ROTARY LOCKING MECHANISM, WHICH IS PREFERABLY INTENDED FOR LOCK CYLINDERS

FIELD OF THE INVENTION

This invention concerns a rotary locking mechanism, preferably for lock cylinders, as used in electromechanical locks that are operated by an electromechanical key incorporating a self-contained power source, and which comprise a cylinder that is housed in a traditional mechanical lock, and which comprises a stator inside which there is housed and operated rotationally a rotor with a housing for one such key, which when turned, causes the rotor to rotate and an eccentric thereof which is able to cause the lock to open, whose rotor has a housing for a locking bolt that is retractable in one said stator in which the rotary locking mechanism itself is housed which in the presence of such key causes extension and retraction of the locking bolt. Said rotor has elements to transmit energy and information between the two electrical circuits.

PRIOR STATE OF THE ART

A known lock in this field is described in patent FR 2 808 552, by Mutter, in which is described a locking mechanism for electronic cylinders, comprising a locking bolt housed in the rotor and which prevents it from moving. Said bolt is kept housed in the rotor by means of a cam operated by a motor. On unlocking, the motor rotates said cam, releasing the bolt and allowing the bolt to withdraw from its housing, thus allowing the rotor to rotate and the lock to operate.

Another known lock is described in patent U.S. Pat. No. 5,628,217, by Herrera, in which is described an electromechanical cylinder whose locking mechanism comprises a locking bolt housed in the rotor and which prevents movement thereof. Said bolt is kept housed in the rotor by means of a motor that operates a cam that converts the rotary movement of the motor into linear movement. Said cam is linked to a locking bolt. At the time of unlocking, the motor rotates said cam, withdrawing the bolt from the housing, allowing the user to rotate the rotor by means of the key and thus open the lock.

Another known lock is described in patent U.S. Pat. No. 6,227,020 B1, by Lerchner, which describes a locking device applicable to electronic cylinders. The mechanism comprises an actuator governed by a motor, and a locking element preventing the rotor from rotating. When the actuator is in the unlocked position, movement of the locking element is allowed and when the rotor rotates, it moves the locking element towards a certain position. When the actuator is in the locking position, on attempting to rotate the rotor, it cannot move the locking element because this is prevented by the actuator.

A drawback of this type of locking mechanism, described in the above patents, is that it is not possible to guarantee locking of the rotor if the key is already inserted and turned in relation to its initial position. If the rotor housing is not aligned with the locking bolt, the mechanism cannot move when the motor is operated to lock the lock.

Thus to guarantee locking, the motor should be operated when the key is withdrawn from the rotor housing when it is in its initial position. Otherwise, the bolt is left outside the rotor housing, allowing the rotor to rotate and the lock is left open.

Another drawback of this kind of mechanism is that they are not suitable for use as a locking system in an electronic cylinder operated with an electronic key, where the power supply of the cylinder comes from a power source integrated in the key itself. This is because they are bi-stable systems, that is to say, they have two stable positions, one locked and the other unlocked. Transition from one position the other is normally achieved by operating the motor. Therefore, it is necessary to apply energy to the motor in order to place it in its locking position and thus lock the mechanism. Because, on withdrawing the key from the cylinder rotor, the power source that supplied the cylinder is also withdrawn, it is not possible to operate the motor in order to get the cylinder to lock.

The main disadvantage of the mechanisms described in the above patents is the need to operate the motor to lock the mechanism and thus close the lock. If the cylinder mechanism receives its power through the electronic key itself, on withdrawing said key the power supply is cut off. Consequently, to lock the mechanism, the motor needs to be operated by means of a power supply included in the cylinder itself.

Another disadvantage of some of the described mechanisms is that the motor has to overcome some type of friction during its actuation. This friction can cause wear to the parts that make up the mechanism or non-actuation in the event of excessive friction.

Friction existing during actuation of the mechanism requires the use of motors of suitable mechanical characteristics to overcome such friction. This involves higher cost and restrictions on choosing the required type of motor.

The aforementioned mechanisms require very high levels of accuracy during manufacture to achieve friction-free parts of minimum dimensions.

DESCRIPTION OF THE INVENTION AND ADVANTAGES

The mechanism provided by this invention comprises: an electric motor, a locking bolt, a plurality of inertial rotating means for converting motor rotation to rectilinear movement along the axis of the locking bolt, an elastic energy accumulator means in opposition in relation to the retraction travel of the locking bolt, and a plurality of rectilinear guidance means for the operative extension/retraction travel of the locking bolt; whereby said electric motor is electrically activated by the energy source of the key inserted in its rotor housing, said inertial conversion rotating means comprises an axially fixed rotary support which is linked to the electric motor shaft, one or a plurality of inertial rotating elements that, in respect of a coaxial rotation axis with the electric motor, produce an increase in the inertial momentum as rotation speed increases, an actuator linked to the locking bolt and coaxially movable with same, a rotational/linear conversion means disposed between the inertial rotary elements and the linked actuator of the bolt, said elastic energy accumulator means is a compressible helical spring that is fitted between the linked movable actuator of the locking bolt and the rotary support axially fixed to the electric motor shaft, and such rectilinear guidance means comprises at least two guide shafts or rods which, by being linked to one of said movable actuator elements and rotary support, penetrate through the other element at diametrically opposed positions.

That is to say, the proposed mechanism essentially comprises the following elements:

- An electric motor that rotates when electrical energy is supplied thereto.
- A conversion mechanism whose function is to convert rotary movement of the electric motor into linear movement along a linear direction, which can be used to achieve cylinder unlocking. This mechanism offers minimal inertia against rotation when rotational speed is minimal. As the rotational speed increases, the parts that make up the conversion mechanism are distributed in such a way that their inertial momentum is increased in respect of the rotational axis, increasing inertia against rotation around such rotational axis. The conversion mechanism consists of the following parts:

A rotary support, whose function is to transmit motor rotation to the entire conversion system.

One or several mobile inertial elements set out in such a way that on increasing the rotational speed of the assembly, they are distributed in such a way that their inertial momentum is increased in respect of the rotational axis.

An actuator able to move linearly in one direction, whose function is to move a locking element.

A transmission element whose function is to transmit rotational movement of the inertial element into a linear movement of the actuator element along a linear direction. This movement can be used to unlock the cylinder.

A locking element that can be fully inserted in a housing existing in the cylinder rotor. Said locking element, in its locked position prevents the cylinder rotor from being rotated with the key, and in its unlocked position allows the cylinder rotor to be rotated with the key.

A return element able to store mechanical potential energy when deformed, whose function is to return the actuator element of the conversion system to its rest position.

Joining of these elements is achieved as follows:

The electric motor shaft and the conversion system are joined via the rotary support. In this way, when the electric motor rotates, the conversion mechanism rotates.

The rotary support and inertial elements are joined in such a way that the support transmits its rotary movement to said inertial elements, and allowing the movement of said inertial elements in such a way that they increase their inertial momentum in relation to the rotation axis as the rotation speed increases.

The inertial elements and the actuator element are joined via the transmission element in such a way that movement caused by rotation of the inertial elements is converted into linear movement of the actuator element.

The return element is set out in such a way that linear movement of the actuator causes the return element to deform so that mechanical potential energy is stored in the return element.

The actuator and locking element are joined together in such a way that the linear movement of the actuator causes withdrawal of the locking element from the rotor housing, allowing the rotation same and the ensuing opening of the lock.

According to a variant of an embodiment of this invention, because the inertial rotating elements are weights of equal mass, said rotational/linear conversion means consists of filaments equal in number to that of the weights and which are held to the movable actuator to extend rectilinearly through an equal number of holes in the rotary support, and each one has one of these weights at its tip. Preferably, these weights and filaments are two in diametrically opposed positions in relation of the rotation axis.

According to another variant of an embodiment of this invention, the inertial rotating elements are weights of equal mass, said rotational/linear conversion means consists of rods joined to said rotary support and movable actuator by an equal number of first knuckles, while each of these rods has a central second knuckle to which one of the weights is disposed. Preferably, said inertial rotating elements are weights of equal mass, said rotational/linear conversion means consists of rods joined to said rotary support and movable actuator by means of an equal number of first knuckles, while each of these rods has a central second knuckle to which one of the weights is disposed.

The main advantages of this invention are as follows:

This invention provides a locking mechanism for electronic cylinders, in which locking of the mechanism is ensured in any situation. The system should be fault-tolerant, that is to say, the mechanism should ensure mechanical locking of the lock even in the event of failure of the electronic part.

The provided system uses a motor to operate the mechanism. The mechanical characteristics of the motor are not critical to good operation of the mechanism in locking and unlocking operations, with the ensuing cost savings when choosing the motor.

Furthermore, because a motor of certain mechanical characteristics is not required, it is possible to choose a motor of minimal dimensions, thus saving space, which is so scarce in this type of locks.

The mechanism does not need any gearing system to multiply the force of the motor, thereby simplifying the mechanism and saving on cost.

The system should guarantee mechanical locking of the lock without having to activate the motor. In other words, merely by disconnecting the energy operating the motor, the mechanism should return to the locked position of its own accord.

The provided system entails minimal friction of its parts during operation. In this way, the wear of the device is minimal, with the ensuing increase to the life of the cylinder.

DRAWINGS AND REFERENCES

For a better understanding of the nature of this invention, in the attached drawings a preferred form of an industrial embodiment is shown, which is an example that is merely illustrative and not restrictive.

Figure 1:
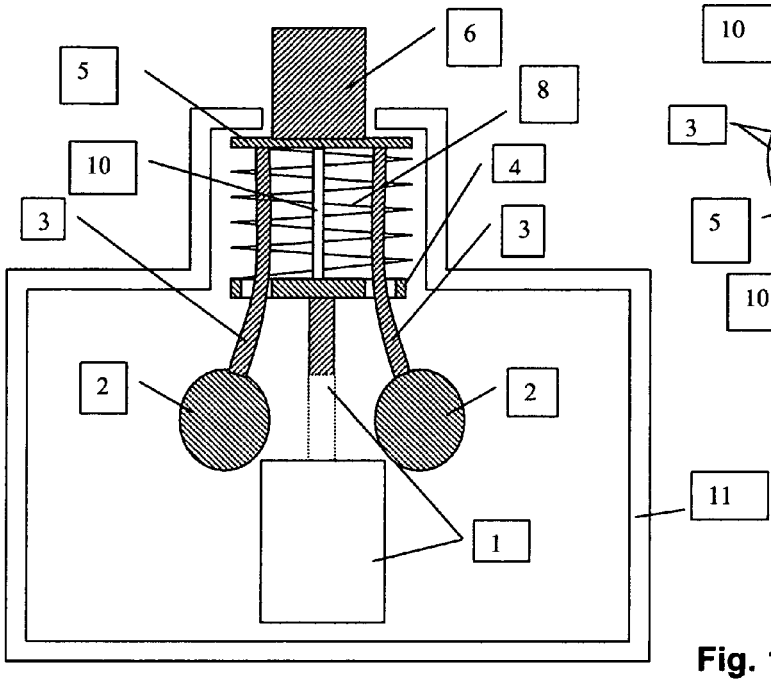
FIG. 1 shows an example of a mechanism according to the invention in rest position, sectioned through the middle with the exception of the electric motor and its shaft (1).
Figure 3:
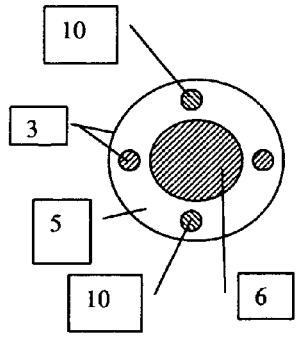
FIG. 3 shows a view from the top of the same mechanism as FIGS. 1 and 2, without the casing or enclosure (11).

These schematic figures use the following references:

1.—Electric motor and motor shaft

2.—Inertial rotating elements or weights

3.—Fixing filaments or rotational/linear transmission element

4.—Rotary support

5.—Movable actuator

6.—Locking bolt

7.—Knuckled rod or rotational/linear transmission element

8.—Return spring

9.—First knuckle

9*a*.—Second knuckle

10.—Guide shafts or rods

11.—Casing or enclosure housing the mechanism

DESCRIPTION OF A PREFERRED EMBODIMENT

Regarding the drawings and references listed above, the attached drawings illustrate two variants of embodiments of the invention for explanatory and non-restrictive purposes.

FIG. 1 shows an example of a system of this type in rest position, where its key elements can be identified:

The conversion mechanism consists of the rotary support (4) joined to the motor shaft (1). Said support (4) has two diametrically opposed holes, through which two independent filaments (3) are fed. At one end of the filaments (3), two equal mass parts are fixed, which from now on shall be called weights (2) and which are the inertial elements. The other end of both filaments (3) is fixed to the movable actuator (5), in diametrically opposed positions. The movable actuator (5) can move linearly in the direction of the rotation axis. Said movable actuator (5) is guided in its movement by two guide shafts or rods (10).

The transmission element is comprised of the filaments (3).

The locking element is a cylindrical bolt (6) that is joined to the movable actuator (5).

The recovery element for elastic energy accumulation is a helical compression spring (8) fitted between the rotary support (4) and the movable actuator. When the movable actuator moves towards the unlocked position, said spring is compressed and stores mechanical potential energy.

The operation of the mechanism during unlocking is as follows:

On supplying electrical energy to the motor, its shaft starts rotating, which rotates together with the rotary support (4). The rotation of said support causes rotation of the weights (2) located at the ends of the filaments (3). Due to the effect of centrifugal force, said weights (2) tend to separate in diametrically opposed directions, separating from the rotation axis and increasing the inertial momentum of the entire inertial element.

As the weights (2) of the inertial element separate, the filaments (3) holding them and which are joined to the movable actuator, tend to move said support along the length of the motor shaft, approaching the rotary support (4).

The movement of the movable actuator (5) causes withdrawal of the locking bolt (6) from the rotor housing, allowing the cylinder rotor to rotate and open the lock.

The approach of the movable actuator (5) and the rotary support (4) causes deformation of the recovery spring (8) and storage of potential mechanical energy, while the mechanism remains in the activated position due to the rotating effect of the electric motor (1).

The movement of the movable actuator causes withdrawal of the locking element from the rotor housing, allowing the cylinder rotor to rotate, opening the lock.

Figure 2:
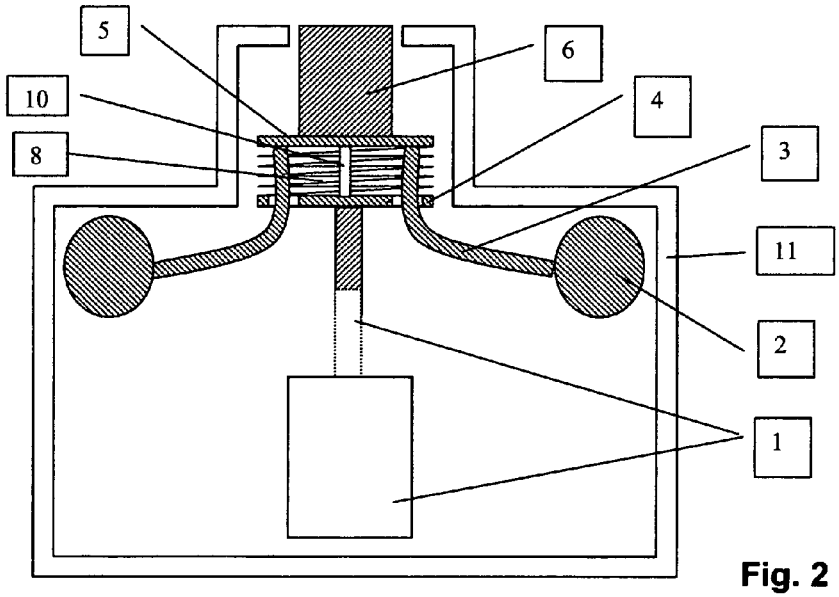
FIG. 2 shows an example of the same mechanism as FIG. 1, but in activated position.

FIG. 2 shows the arrangement of the key elements of the described mechanism when it is in the activated position.

The operation of the mechanism during locking is as follows:

On removing electrical power to the motor (1), the motor (1) does not contribute to rotation of the rotary support (4).

The friction of the parts that make up the entire system causes a reduction in the angular speed of the entire assembly.

As the rotation speed to the weights (2) reduces, the centrifugal force keeping the weights (2) separate from the rotation axis is reduced. The reduction in the centrifugal force allows the weights (2) to approach the rotation axis, reducing their inertial momentum. In this way, the filaments (3) that hold the weights and which are joined to the movable actuator no longer contribute to approaching the movable actuator to the rotary support (4).

The mechanical potential energy stored in the compressed return spring tends to separate the movable actuator from the rotary support (4).

The movement of the movable actuator towards its rest position causes insertion of the locking element into the rotor housing, preventing the cylinder rotor from rotating and causing the lock to close.

Figure 4:
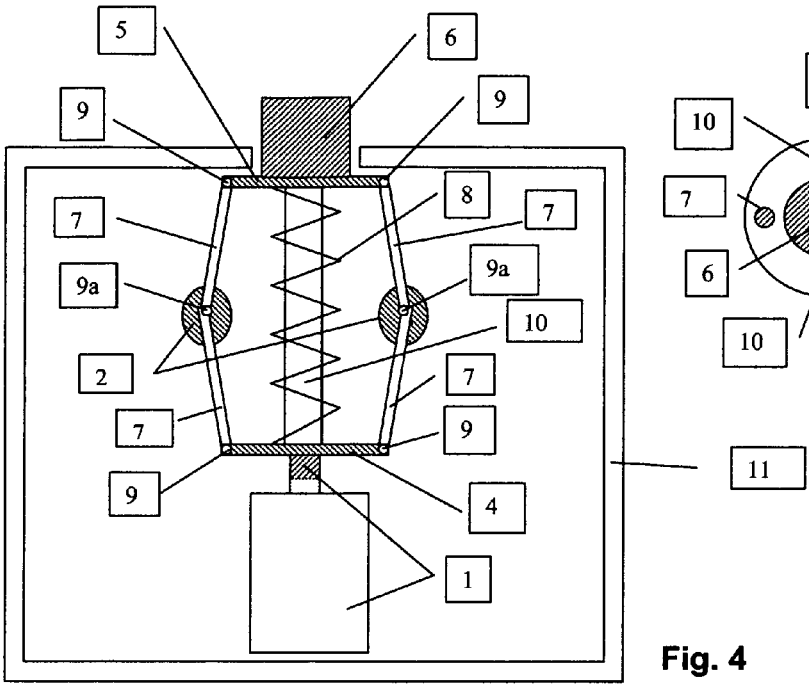
FIG. 4 shows a second variant of a mechanism according to the invention in rest position.
Figure 6:
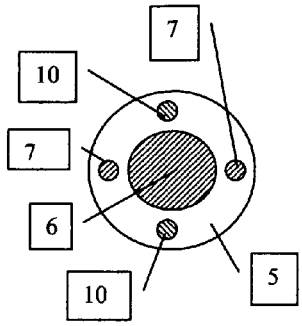
FIG. 6 shows a view from the top of the same variant of FIGS. 4 and 5.

FIG. 4 shows another example of a system of this type in rest position, where its key elements are identified:

The conversion mechanism consists of a rotary support (4) joined to the motor shaft and a movable actuator (5). To said rotary support (4) and in diametrically opposed positions, the ends of two rods or rotational/linear transmission elements (7) are fixed by means of two knuckles (9), in such a way that the rods are allowed to rotate in relation to said support. At the other end of both rods, two parts of equal mass (2) are fixed, which from now on shall be called weights (2) and which constitute the inertial elements. In the movable actuator (5) and in diametrically opposed positions, the ends of the two rods or rotational/linear transmission elements (7) are fixed by means of two first knuckles (9) in such a way that the rods or rotational/linear transmission elements (7) are allowed to rotate in relation to said support. The other ends of both rods or rotational/linear transmission elements (7) are articulated by means of an equal number of second knuckles (9*a*) to which the aforementioned weights (2) are fixed.

The transmission element comprises the knuckled rods or rotational/linear transmission elements (7).

The locking element is a locking bolt (6) that is joined to the movable actuator (5).

The recovery element is a spring (8) fitted between the rotary support (4) and the movable actuator (5). As the movable actuator (5) moves towards the unlocked position, said spring (8) is compressed and stores mechanical potential energy.

The operation of the mechanism during unlocking is as follows:

On supplying electrical energy to the motor, its shaft starts to rotate, which rotates together with the rotary support (4). The rotation of the support causes rotation of the weights (2) located at the ends of the rods or rotational/linear transmission elements (7). Due to the effect of centrifugal force, said weights (2) tend to separate in diametrically opposed directions, separating from the rotation axis and increasing the inertial momentum of the entire inertial element.

As the weights (2) separate, the rods or rotational/linear transmission elements (7) that hold them tend to move the movable actuator (5) along the length of the direction of the motor shaft (1), approaching the rotary support (4).

The movement of the movable actuator (5) causes withdrawal of the locking bolt (6) from the rotor housing, allowing the cylinder rotor to rotate and open the lock.

The movement of the movable actuator (5) causes the return spring (8) to deform and store potential mechanical energy, while the mechanism remains in the activated position due to the rotating effect of the electric motor (1).

The movement of the movable actuator (5) causes withdrawal of the locking bolt (6) from the rotor housing, allowing the cylinder rotor to rotate and open of the lock.

Figure 5:
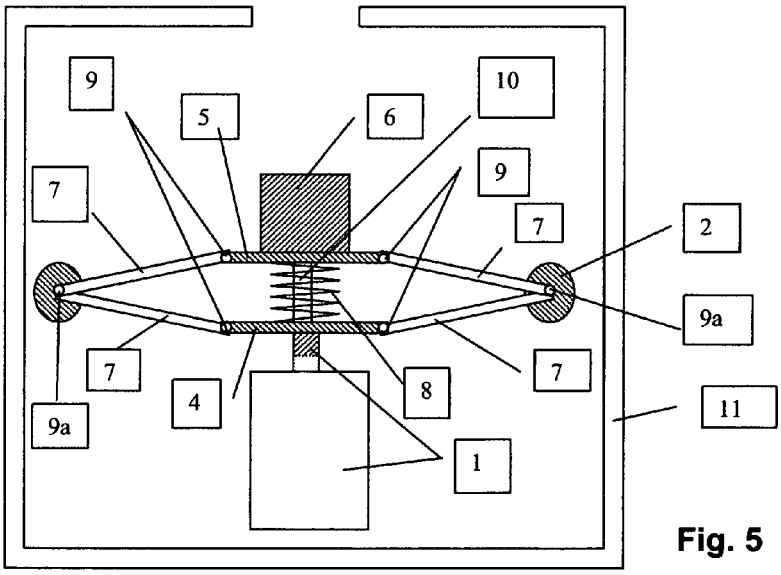
FIG. 5 shows the same variant as FIG. 4, but in activated position.

FIG. 5 shows the arrangement of the key elements of the described mechanism when it is in the activated position.

The operation of the mechanism during locking is as follows:

On removing electrical energy from the motor (1), the motor (1) does not contribute to the rotation of the inertial rotary support (4).

The friction of the parts that make up the entire system causes a reduction in the angular speed of the entire assembly.

On reducing the rotational speed of the weights (2), the centrifugal force keeping the weights (2) separate from the rotation axis is reduced. The reduction of the centrifugal force allows the two weights (2) to approach the rotation axis, reducing their inertial momentum.

The mechanical potential energy stored in the compressed return spring (8) tends to separate the movable actuator (5) from the support (4).

The movement of the movable actuator (5) towards its rest position causes insertion of the locking bolt (6) into the rotor housing, preventing the cylinder rotor from rotating, thus closing the lock.

In the described mechanisms, it might happen that, on deactivating the system, the rotor is rotated a certain angle in such a way that the locking bolt (6) is not aligned with its housing in the rotor, in such a way that the locking bolt (6) cannot house itself in the rotor. In this case, the locking bolt (6) prevents the movable actuator (5) from moving in the direction of the axis.

In this situation, because the rotation of the inertial element stops, the centrifugal force that maintains the weights (2) separate from the rotation axis and the return spring (8) compressed disappears. However, said return spring (8) cannot decompress because the movable actuator (5) cannot move in the direction of the axis because the locking bolt (6) cannot house itself in the rotor.

When the rotor rotates in such a way that the locking bolt (6) is aligned with its rotor housing, the return spring (8) will push the movable actuator (5), which in turn will push the locking bolt (6), inserting said locking bolt (6) into its housing and preventing the rotor from rotating. That is to say, no key needs to be present to ensure that the lock is perfectly closed, rather the act of physically removing the certain key compels the system to tend to its locking state, where the bolt (6) tries to house itself in its rotor housing and will do so as soon as it can; if on removing the key, there is some non-alignment between the bolt (6) and its housing, as soon as any attempt is made to rotate the rotor without the key, the required alignment will be achieved and rotary locking of the rotor will be established.

The invention claimed is:

1. Rotary locking mechanism, for lock cylinders in electromechanical locks that are operated by means of an electromechanical key incorporating a self-contained energy source, and which comprises a cylinder that is housed in a traditional mechanical lock and which comprises a stator, in the core of which a rotor is housed and operates rotationally, said rotor has a housing for one said key which, on being turned, causes rotation of the rotor and an eccentric thereof which is capable of causing opening of the lock, which rotor has a housing for a locking bolt which is retractable in one said stator in which is housed the actual rotary locking mechanism which in presence of said key produces extension and retraction of the locking bolt (6), comprising: an electric motor (1), a locking bolt (6), an inertial rotating means for converting rotation of the motor (1) into a rectilinear movement along the axis of said locking bolt (6), an elastic energy accumulating means arranged in opposition to the retraction travel of the locking bolt (6), and rectilinear guide means for providing rectilinear guidance of the operating extension/retraction travel of the locking bolt (6); wherein said electric motor (1) is activated electrically by the energy source of the key inserted in its housing or in the rotor, said inertial conversion rotating means comprises an axially fixed rotary support (4) which is linked to the shaft of the electric motor (1), one or several inertial rotating elements (2) which, in relation to a coaxial rotation axis with that of the electric motor (1), produce an increase in the inertial momentum on increasing their rotational speed, an actuator linked to the locking bolt (6) and which is coaxially movable therewith, a rotational/linear conversion means (3, 7) that is installed between the inertial rotating elements (2) and the actuator (5) linked to the locking bolt (6), said elastic energy accumulator is a compressible helical spring (8) that is installed between the movable actuator (5) linked to the locking bolt (6) and the rotary support (4) axially fixed to the shaft of the electric motor (1), and such rectilinear guidance means comprises at least two guide shafts or rods (10) that, joined to one of said elements of movable actuator (5) and rotary support (4), closely penetrate through the other of these elements in diametrically opposed positions.

2. Rotary locking mechanism, for lock cylinders, in accordance with claim 1, wherein said inertial rotating elements (2) are weights (2) of equal mass, said rotational/linear conversion means comprises several filaments (3) in equal number to that of the weights (2) which are held to the movable actuator (5) and extend rectilinearly through the same number of holes in the rotary support (4) and each one has one of said weights (2) at its end.

3. Rotary locking mechanism, for lock cylinders, in accordance with claim 2, wherein said weights (2) and filaments (3) are both positioned in diametric opposition in relation to the rotation axis.

4. Rotary locking mechanism, for lock cylinders, in accordance with claim 1, wherein said inertial rotating elements (2) comprise several weights (2) of equal mass, said rotational/linear conversion means comprises rotational/linear transmission rods or elements (7) that are joined to said rotary support (4) and movable actuator (5) by means of the same number of first knuckles (9) while each one of the rotational/linear transmission rods or elements (7) has a central second knuckle (9*a*) to which one of said weights (2) is disposed.

5. Rotary locking mechanism, for lock cylinders, in accordance with claim 1, wherein said weights (2) and rotational/linear transmission rods or elements (7) are two in diametrically opposed positions.

6. Rotary locking mechanism, for lock cylinders, in accordance with claim 1, wherein the rotation of the motor (1) provides for rotations of the rotary support (4) which is joined to the inertial rotaries or weights (2) by means of filaments (3) or articulated rods (7), whereby rotation provides for centrifugal separation of the weights (2) in relation to their rotation axis with the ensuing movement of the actuator support (5) against compression of the return spring (8).

* * * * *